United States Patent [19]

Biedermann

[11] 4,030,726

[45] June 21, 1977

[54] DOCUMENT FEEDING MECHANISM

[75] Inventor: Horst H. Biedermann, Augsburg, Germany

[73] Assignee: NCR Corporation, Dayton, Ohio

[22] Filed: Dec. 11, 1975

[21] Appl. No.: 639,684

[52] U.S. Cl. ..... 271/246; 197/127 R; 197/140; 271/273

[51] Int. Cl.[2] ..... B65H 9/06

[58] Field of Search ..... 271/246, 245, 274, 273, 271/265, 266, 3, DIG. 9, 275, 264, 236, 247; 197/127 R, 140

[56] References Cited

UNITED STATES PATENTS

| | | | |
|---|---|---|---|
| 330,485 | 11/1885 | Hirt et al. | 271/273 |
| 1,098,234 | 5/1914 | Dexter | 271/246 |
| 3,069,157 | 12/1962 | Mersereau et al. | 271/34 X |
| 3,266,612 | 8/1966 | Kittel et al. | 197/127 R |
| 3,576,163 | 4/1971 | Lawson | 271/274 X |

*Primary Examiner*—Evon C. Blunk
*Assistant Examiner*—Bruce H. Stoner, Jr.
*Attorney, Agent, or Firm*—J. T. Cavander; Albert L. Sessler, Jr.; Elmer Wargo

[57] ABSTRACT

A document feeding mechanism which may be used in an automatic line finding device for a business machine which includes an entrance throat for inserting sheet-like documents therein. The mechanism includes an endless belt and a document engaging structure which are mounted on opposed sides of the entrance throat of the machine. The document engaging structure has first and second rollers thereon and an abutment member which is positioned in the throat to enable a document which is manually inserted in the throat to abut thereagainst and to be initially located thereby. An actuating linkage is used to pivot the document engaging structure so as to cause the first roller to press the document against the endless belt and grip it, and thereafter, the abutment member is moved out of the entrance throat as the second roller is simultaneously moved towards the endless belt to also grip the document therebetween. Thereafter, the endless belt is driven under the control of the line finding device to automatically locate a line on the document with reference to the associated print head of the business machine.

4 Claims, 3 Drawing Figures

19'
12'
19

96
2
14'
54
10
20
LINE FINDING CONTROL MEANS
14
BELT DRIVE MEANS
48
42
98
30
60
38
94
36
52
26
86
24
ACTUATOR
84
90
92
16
44
80
34
BELT DRIVE MEANS
50
46
2

DOCUMENT FEEDING MECHANISM

BACKGROUND OF THE INVENTION

This invention relates to a document feeding mechanism which may be a part of an automatic line finding device of a business machine like an accounting machine.

The prior art document feeding mechanisms which are used with automatic line finding devices generally use opposed feed rollers which grip the document to be fed therebetween, and one of the rollers is driven or rotated while the other one is simply rotated in conjunction therewith and presses the document against the driven roller. This type of feeding arrangement has the disadvantage of introducing inaccuracies into the system as the diameters of the feed rollers begin to get smaller due to wear. It is obvious that as the diameters of the feed rollers get smaller due to wear or due to a variation in feed rollers having diameters which are less than the desired nominal diameter, each rotation of the fed rollers will not produce the desired linear displacement of the record medium or document being fed thereby, resulting in inaccuracies in locating a particular line of the document at the print station in the business machine.

The present invention obviates the problems mentioned in the previous paragraph in that the document feeding mechanism disclosed herein utilizes a gear driven endless belt and counter rollers which maintain the document in feeding engagement with the endless belt. Because of the gear driven belt, there is no slippage between the endless belt and its driving means, and the use of a gear driven belt greatly reduces errors due to manufacturing tolerances when compared to feeding arrangements using opposed rollers. For example, if a driving gear has 10 teeth ($n_1$) and the endless belt has 100 complementary teeth ($n_2$) and a belt length (L) of 500 mm., each complete rotation of the drive gear will move the belt a distance ($s$) where:

$$s = (n_1 L/n_2) = 10\ (500)/100 = 50 \text{ mm.}$$

A Typical endless belt having a nominal length of 500 mm. may have a length tolerance of ±0.16 mm. Thus, after one rotation of the driving gear, the maximum displacement error of the endless belt is ±0.016. If a conventional feed roller is used for feeding a document the same distance (50 mm.) in one complete rotation of the feed roller, the feed roller would have to have a nominal diameter of approximately 15.9 mm. A typical tolerance for a feed roller having a nominal diameter of 15.9 mm. is ±0.05 mm.; and consequently, the maximum error after one complete revolution of the roller is (77 × 0.05) or about 0.15 mm. This maximum error of 0.15 mm., for a conventional, opposed, feed roller arrangement, is about ten times the error which is introduced by the document feeding mechanism of this invention.

Another feature of this invention is that the document feeding means disclosed herein utilizes a novel document engaging structure which is used in conjunction with the endless belt to provide a simple, and economical means for feeding documents for use with an automatic line findng device.

Some prior art feeding devices are shown in British Pat. No. 1,349,295 which waas published on Apr. 3, 1974, and U.S. Pat. No. 3,894,624 which issued on July 15, 1975.

SUMMARY OF THE INVENTION

This invention relates to a document feeding mechanism, which in a preferred embodiment, is shown as a part of an automatic line finding device of a business machine like an accounting machine.

The document feeding mechanism of this invention comprises a transport means like a belt means and a document engaging means which are located on opposed sides of a document entrance throat located in the business machine. The document engaging means includes first and second spaced engagement means, like first and secnd rollers thereon, and an abutment means positioned in the throat to enable a document which is manually inserted therein to abut thereagainst. Moving means like a lever means are used for pivotally moving the document engaging means so as to bring the first roller into gripping engagement with the belt means to retain a document therebetween, and thereafter, move the abutment means out of the throat and simultaneously move the second roller into engagement with said belt means to retain the document therebetween. Means for driving the belt means are provided to enable the document fed thereby to be moved in accordance with the dictates of the automatic line finding device.

BRIEF DESCRIPTION OF THE DRAWINGS

The advantages and uses of this invention will become more readily understood in connection with the following detailed description and drawings in which.

DETAILED DESCRIPTION OF THE INVENTION

Figure 1:
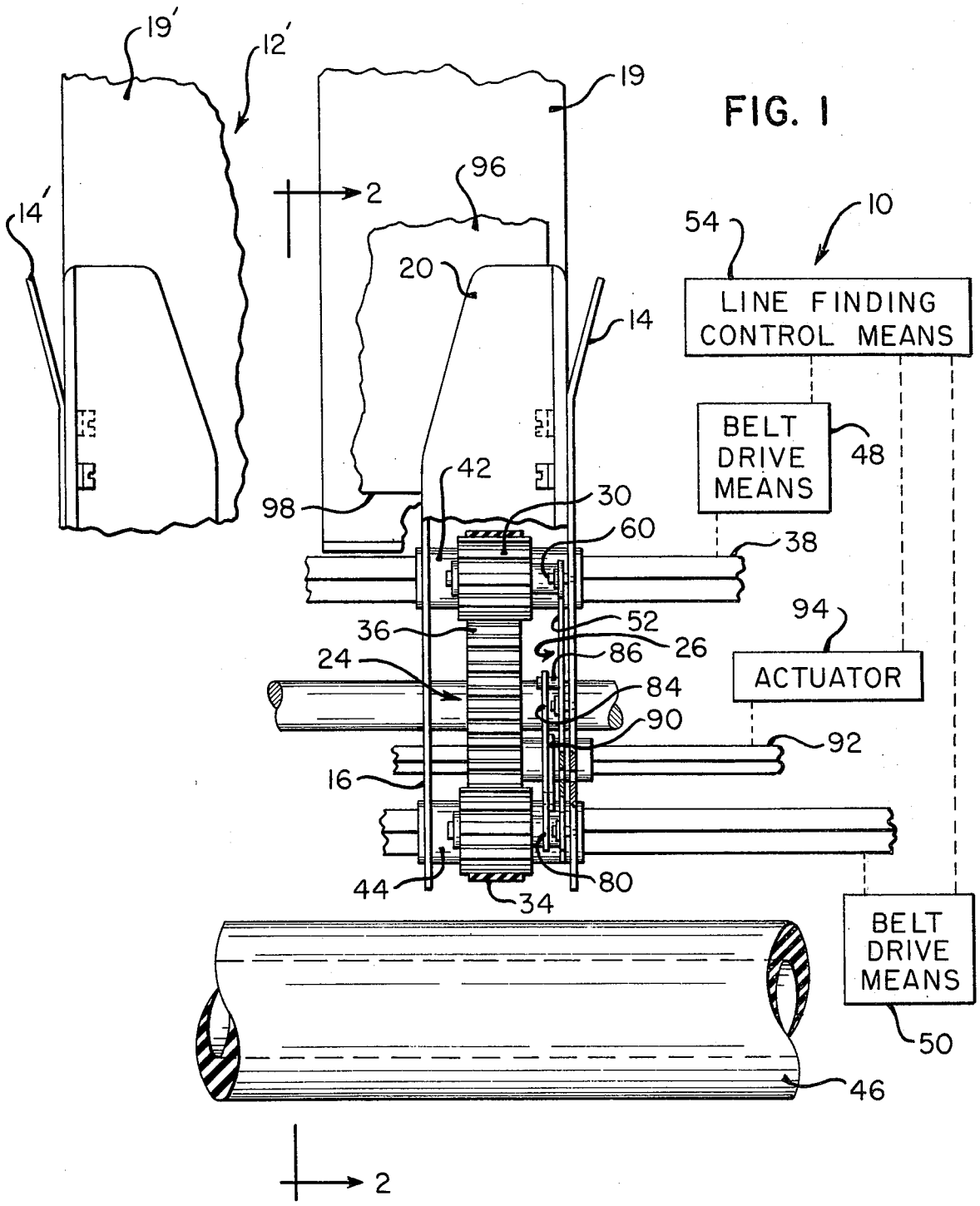
FIG. 1 is a front view, in elevation of a portion of a business machine having the document feeding mechanism of this invention incorporated therein, and showing a transport means or a belt means and document engaging means used therein.
Figure 2:
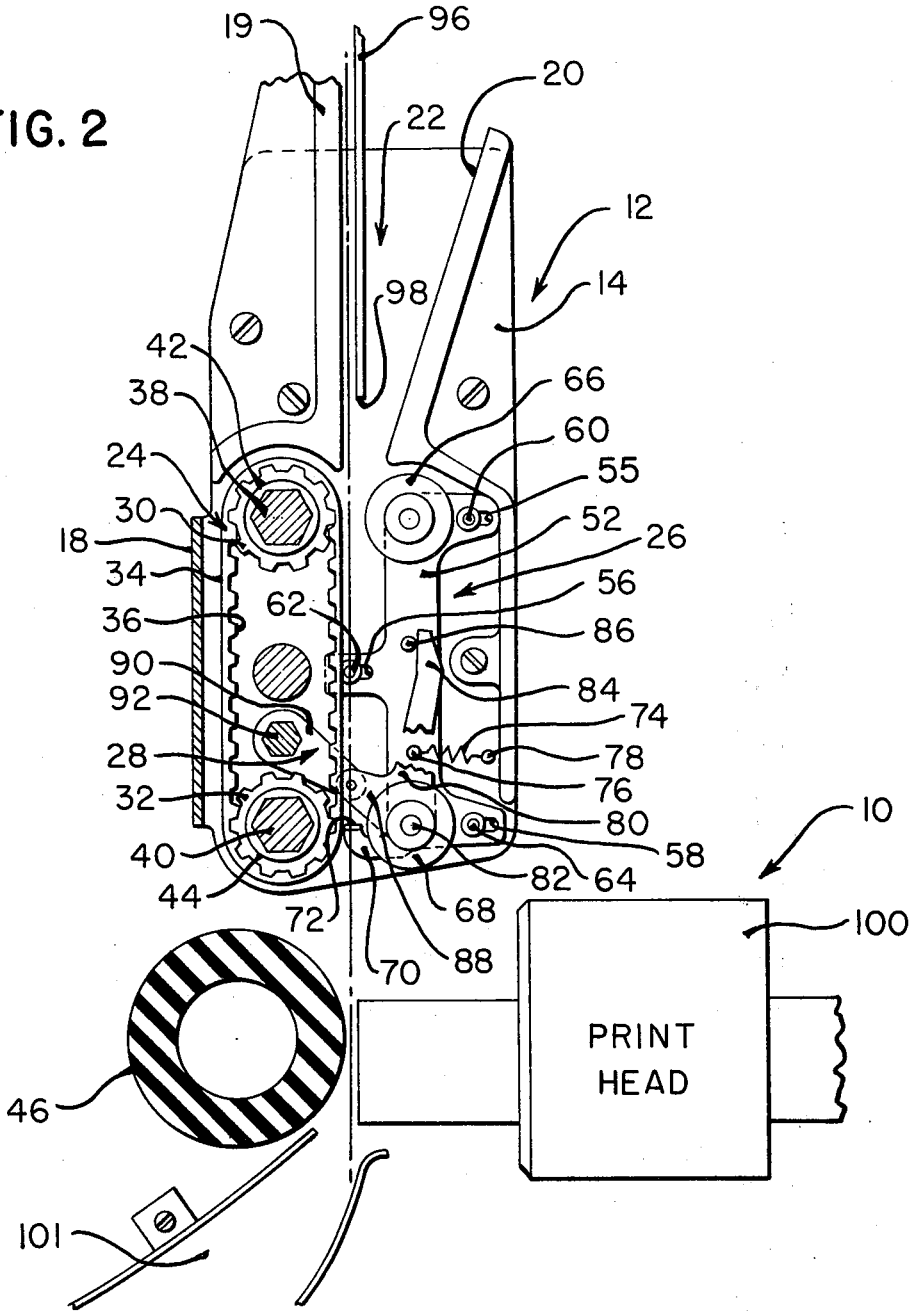
FIG. 2 is a side view, in elevation taken along line 2—2 of FIG. 1 to show additional details thereof.

FIG. 1 and 2 show a portion of business machine designated generally as 10 in which the document feeding mechanism 12 of this invention is located. The document feeding mechanism 12 (hereinafter called mechanism 12) includes frame means members 14, 16 which are spaced apart in parallel relationship and interconnected by a supporting plate 18 shown in FIG. 2. A vertically aligned plate 19 (FIG. 2) and a second plate 20 are positioned in converging relationship relative to each other to form a document entrance throat designated generally as 22. The mechanism 12 also comprises a transport means like a belt means 24, a document engaging means 26 and a moving means like a lever means 28, as best seen in FIG. 2, for pivotally moving the document engaging means 26 into operative engagement with the belt means 24.

The belt means 24 includes a pair of spaced, toothed rollers 30, 32 on which an endless belt 34 is mounted. The belt 34 has complementary teeth 36 thereon to mate with the teeth on the rollers 30, 32 to provide for a positive or nonslippng engagement therewith. Each roller 30, 32 has a hexagonally-shaped, internal hole therein to mate with hexagonally-shaped shafts 38 and 40, respectively, and to enable the rollers 30, 32 to be axially shiftable thereon and to form a driving connection therebetween. The toothed rollers 30, 32 have outer diameter portions 42, 44 respectively, which are rotatably mounted in matching aligned holes (not shown) in the frame means members 14 and 16 to enable the mechanism 12, if desired, to be axially shiftable on the shafts 38, 40 for locating the mechanism 12 relative to a platen 46 of the business machine 10. The belt 34 is driven by rotating one or both of the shafts 38, 40 in a clockwise direction as viewed in FIG. 2.

The driving of the shafts 38, 40 is accomplished by any conventional means such as a pulley and reversible motor means which are shown only schematically as belt drive means 48 and 50, respectively. The belt drive means 48 and 50 are under the control of a conventional line finding control means 54 which is shown only schematically.

The document engaging means 26 (FIGS. 1 and 2) includes a thin, plate-like, support means 52 having the general shape best shown in FIG. 2. The support means 52 has elongated holes 55, 56, and 58 therein which are sufficiently large and are aligned to enable the support means 52 to be moved towards and away from the belt 34 and to be pivoted slightly on associated mounting pins 60, 62 and 64, respectively, which are upstanding from the frame means member 14. The support means 52 has a first end on which first engagement means like a first roller 66 is rotatably mounted and a second opposed end on which second engagement means like a second roller 68 is rotatably mounted; these rollers 66 and 68 (FIG. 2) are not shown in FIG. 1 to facilitate the showing of the belt means 24 therein. The lower or second end of the support means 52 also has an extension 70 with an abutment surface 72 thereon to receive the edge of a document which is manually inserted in the document entrance throat 22. The abutment surface 72 is positioned in the throat 22 when the document engaging means is in the right most position (away from the belt means 24) as viewed from and as shown in FIG. 2. A tension-type spring 74, having one end secured to an upstanding pin 76 on the support means 52 and having the other end secured to a pin 78 located in the frame means member 14, is used to resiliently bias the lower or second end of the support means 52 away from the belt means 24.

The lever means 28 for moving the document engaging means 26 into operative engagement with the belt means 24 is best shown in FIG. 2. The lever means 28 includes a bell crank lever 80 which is pivotally mounted on a pin 82 (on which roller 68 is also mounted) which is upstanding from the support means 52. One end 84 of the lever 80 engages a pin 86 upstanding from the support means 52 and the other end 88 is pivotally joined to one end of a lever 90 whose remaining end has a hexagonally-shaped opening therein to form a driving connection with a hexagonally-shaped driving shaft 92 on which the lever 90 is axially, slidably mounted. The lever means 28 is actuated by rotating the shaft 92 in a clockwise direction (as viewed in FIG. 2) by any conventional actuator 94 (FIG. 1) which is operated under the control of the line finding control means 54.

The operation of the document feeding mechanism 12 is as follows. With the document engaging means 26 in the position shown in FIG. 2 (due to the bias of spring 74), a document 96 is manually inserted into the entrance throat 22 until the lower edge 98 of the document abuts against the abutment surface 72 which is positioned in the path of the document 96, and until the right side of the document 96 (as viewed in FIG. 1) engages the frame means number 14. A suitable switch (not shown but associated with the control means 54) is then actuated to cause the mechanism 12 to be operated. The actuator 94 (like a solenoid) then rotates the shaft 92 in a clockwise direction (as viewed in FIG. 2) causing the lever 90 to also pivot in a clockwise direction. As the lever 90 pivots in a clockwise direction, it rotates the bell crank lever 80 in a counter-clockwise direction, causing the end 84 thereof to abut against the pin 86, and thereby pivot the upper end of document engaging means 26 towards the belt means 24 to bring the first roller 66 into operative engagement with the belt means 24 and grip the document 96 therebetween. After the roller 66 and belt means 24 grip the document 96 therebetween, continued counter-clockwise rotation of the bell crank lever 80 will cause the lower end of the document engaging means 26 to move towards the belt means 24 against the bias of spring 74. As the lower end of the document engaging means 26 moves towards the belt means 24, the abutment surface 72 is moved out of the throat 22, and the second roller 68 is simultaneously brought into gripping engagement with the document 96. After the abutment surface 72 is moved out of the throat 22, the throat is clear to permit the document 96 to be moved by the belt means 24 so that a predetermined line on the document 96 may be positioned (under the control of the line finding control means 54) between the platen 46 and print head 100 of the business machine 10 to effect printing thereon. The belt drive means 48 and/or 50 are then actuated by the line finding control means 54 causing the shafts 38, 40 to be rotated as previously described, and as these shafts rotate a predetermined amount, the document 96 is fed between the belt means 24 and the rollers 66 and 68 so as to position the selected line on the document in printing relationship with the print head 100. A suitable discharge chute or document receiving channel 101 is located under the platen 46. While only one document feeding mechanism 12 is shown, it is obvious that two such mechanisms 12 may be used; consequently, a second mechanism 12' (FIG. 1) identical to the first mechanism 12 may be used therewith. Aside from some obvious differences, like frame means member 14' being a mirror image of frame means member 14, the two mechanisms 12 and 12' are identical, in operation, and consequently mechanism 12' is not described in any further detail. The two mechanisms 12 and 12' may be axially moved on the shafts like 38, 40 to permit them to be adjustably spaced to receive the width of a document therebetween.

Figure 3:
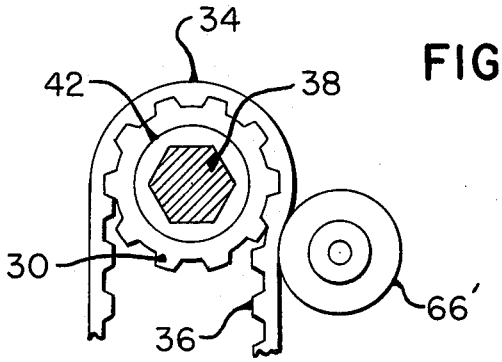
FIG. 3 is a side view, in elevation, of a second embodiment of this invention, showing how the belt means and an opposing roller of the document engaging means are located relative to each other.

FIG. 3 shows a second embodiment of a portion of the mechanism 12 which is identical to that shown in FIGS. 1 and 2 except for the fact that the first roller 66' (FIG. 3) of the document engaging means 26 has an axis of rotation which is slightly offset relative to the axis of rotation of the shaft 38 so as to enable the belt 34 to partially wrap around the periphery of the roller 66' to provide for a better gripping action due to a large gripping area between the belt 34 and the roller 66'. In the embodiment shown in FIG. 2, the axis of the roller 66 and the axis of shaft 38 are aligned relative to each other and lie on a line which is perpendicular to the direction of travel of the document 96 through the throat 22, so that the belt 34 and the roller 66 make contact with each other along a line when in gripping engagement with each other.

What is claimed is:

1. A document feeding mechanism for use with a business machine having a document entrance throat comprising: frame means;

transport means and document engaging means mounted on said frame means on opposed sides of said throat;

said document engaging means having first and second spaced engagement means thereon, and an abutment means positioned in said throat to enable a document inserted in said throat to abut thereagainst;

moving means for moving said document engaging means so as to bring said first engagement means into engagement with said transport means to retain a document therebetween and thereafter move said abutment means out of said throat and simultaneously move said second engagement means into engagement with said transport means to retain said document therebetween; and means for driving said transport means;

said document engaging means comprising:

a support means and means for mounting said support means on said frame means for pivotal movement relative to said transport means and movement towards and away from said transport means;

said first engagement means being rotatably mounted on a first end of said support means and said second engagement means being rotatably mounted on a second end of said support means; and said abutment means being located at said second end of said support means.

2. The mechanism as claimed in claim 1 in which said support means has a stud thereon and said means for mounting said support means includes a resilient means for biasing said second end of said support means away from said transport means;

said moving means including a bell crank lever being pivotlly mounted on said support means and having one end in operative engagement with said stud and the other end thereof operatively connected to said moving means.

3. A document feeding mechanism for use with a business machine having a document entrance throat, comprising:

a support means mounted on a first side of said throat for pivotal movement relative to said throat and movement towards and away from said throat;

said support means having first and second ends and first and second rollers rotatably mounted on said first and second ends, respectively;

said support means also having an abutment means located near said second end against which a document abuts when inserted into said throat;

bias means for resiliently biasing said second end of said support means away from said throat;

transport means located on a second side, opposite to said first side, of said throat;

lever means for pivoting said support means so as to bring said first roller into feeding engagement with said transport means to grip said document therebetween, and thereafter move said abutment means out of said throat and simulatenously move said second roller into feeding engagement with said transport means against the bias of said bias means; and means for driving said transport means when said first and second rollers are in feeding engagement therewith.

4. The mechanism as claimed in claim 3 in which said transport means includes an endless belt means.

* * * * *